United States Patent [19]

Jonasson

[11] 4,416,090

[45] Nov. 22, 1983

[54] BELT SANDING MACHINE

[75] Inventor: Bertil Jonasson, Eneryda, Sweden

[73] Assignee: Landskrona Produktion AB, Sweden

[21] Appl. No.: 377,893

[22] Filed: May 13, 1982

Related U.S. Application Data

[63] Continuation of Ser. No. 142,502, Apr. 21, 1980, abandoned.

[30] Foreign Application Priority Data

Apr. 25, 1979 [SE] Sweden ..... 7903612

[51] Int. Cl.[3] ..... B24B 21/04

[52] U.S. Cl. ..... 51/138; 51/141

[58] Field of Search ..... 51/61, 76 R, 137, 138, 51/141; 144/128, 129; 100/154; 83/431

[56] References Cited

U.S. PATENT DOCUMENTS

| | | | |
|---|---|---|---|
| 1,254,044 | 1/1918 | Johnson | 269/310 |
| 2,895,263 | 7/1959 | Reynolds . | |
| 3,074,210 | 1/1963 | Eschenburg et al. | 51/138 |
| 3,134,205 | 5/1964 | Uegsund | 51/138 |
| 3,325,947 | 6/1967 | Burt | 51/138 |
| 3,394,501 | 7/1968 | Carlson et al. | 51/138 |
| 3,603,041 | 9/1971 | McDonald | 51/138 |
| 3,832,807 | 9/1974 | Kiser | 51/138 |

FOREIGN PATENT DOCUMENTS

| | | | |
|---|---|---|---|
| 922306 | 1/1955 | Fed. Rep. of Germany . | |
| 2353244 | 5/1975 | Fed. Rep. of Germany . | |
| 2634829 | 2/1978 | Fed. Rep. of Germany | 51/141 |
| 44-49874 | 1/1969 | Japan | 51/141 |
| 44-2959 | 2/1969 | Japan | 51/141 |
| 553623 | 9/1974 | Switzerland . | |

*Primary Examiner*—Harold D. Whitehead

*Attorney, Agent, or Firm*—Beveridge, De Grandi & Kline

[57] ABSTRACT

A belt sanding machine for plane-sanding of a surface and comprising two sanding units and, as seen in the feed direction, in front of, between and behind these sanding units guides or pressure beams for setting the sanding depth, and a table (9,10) for pressing the workpiece against the sanding units and pressure beams. The table is designed in such a way as to allow both dimensioning or adjusting a workpiece to an almost exact plane-parallel shape and finish sanding with an accurately predetermined sanding depth regardless of whether the thickness of the workpiece varies locally.

The sanding machine is characterized in that the table includes a number of pressure studs movable towards and away from the sanding units and the pressure beams the pressure studs being arranged to be actuated by a pressurized fluid.

9 Claims, 4 Drawing Figures

BELT SANDING MACHINE

This is a continuation of application Ser. No. 142,502 filed Apr. 21, 1980 and now abandoned.

BACKGROUND OF THE INVENTION

The present invention relates to a face plate sander, especially a belt sanding machine, e.g. comprising two sanding units and, as seen in the feed direction, in front of, between and behind these units guides or pressure beams for setting the sanding depth. The inventive device comprises a table for pressing a workpiece against the sanding units and the guides, the table being designed, according to the invention, in such a manner as to allow both dimensioning or adjusting of the workpiece to an almost exact plane-parallel shape and finish sanding of the workpiece with a very accurate, predetermined sanding depth no matter whether the workpiece has a thickness which varies considerably in the feed direction or in a direction transverse thereto.

Conventional sanding machines of the type indicated above usually comprises a feeding conveyor provided below the sanding units for feeding the workpieces through the machine. The table such as mentioned above is provided below the feeding conveyor and has the purpose of pressing the workpiece supported by the conveyor with a suitable force against the sanding units and the guides. In conventional sanding machines the table proper is usually completely rigid. However, the table is resiliently suspended to allow minor deviations from the intended dimensions of the workpieces. Even if the table is resilient in a way, this does not mean that the sanding depth is completely independent of the thickness distribution of the workpiece. Thus, conventional sanding machines usually have a bigger working depth at such portions of the workpiece having a bigger thickness, as the pressing force of a rigid table, due to the spring suspension, will increase with the thickness of the workpiece. The reason for this is that the spring means provide a pressing force against the sanding units that is proportional to the extent of deformation of the spring means.

Further, the rigid table of a conventional sanding machine has the drawback that the workpiece could be exposed to very large local loads if there is a locally protruding portion facing the feeding conveyor. In such a case the total spring force of the table will be concentrated on this small portion which might cause deformations of the workpiece, in turn causing a much increased sanding depth at a point opposite the protruding portion. In such cases it often happens that the sanding depth of a conventional sanding machine will be of such a magnitude that the veneer of a veneered workpiece is completely sanded through.

The present invention has for its object to provide a sanding machine of the kind indicated above and designed to eliminate the above problems and difficulties in achieving an accurately defined sanding depth irrespectively of irregularities of the thickness of the workpiece. Thus, the invention has for its object to provide a device for defining the sanding depth so accurately that there is no risk of sanding through even a thin layer of varnish on the workpiece.

SUMMARY OF THE INVENTION

According to the invention this object is achieved if the belt sanding machine having at least one sanding unit at the front and back side of which, as seen in the feed direction, there is provided guide means for setting the sanding depth and at least one pressing table for pressing the workpiece against the sanding unit and the guide means, is characterized in that the pressing table comprises a number of pressure means movable towards and away from the sanding unit and the guide means the pressure means, being arranged to be actuated towards the sanding unit and the guide means under influence of a pressurized fluid.

A practical embodiment of the invention is characterized in that the pressure means are provided in rows transversely of the feed direction of the machine, the pressure means in each row cooperating with a common pressure chamber for pressurized fluid.

A sanding machine particularly well suited for carrying the invention into effect comprises, as seen in the feed direction, a first sanding unit, in which a rotating drum brings a first sanding belt to contact the workpiece, and then a second sanding unit, in which a pressure shoe brings a second sanding belt to contact the workpiece, guide means or pressure beams being provided in front of, between and behind the sanding units. According to the invention such a sanding machine is characterized in that there is provided one row of pressure means for cooperating with each guide means and one row of pressure means for cooperating with the sanding unit comprising the rotating drum, the pressure chamber for this row having its own supply of pressurized fluid and being located in a vertical plane comprising the center axis of the drum, the pressure chambers for the other of said rows being connected with each other.

According to the invention it is preferred that the pressure means be designed as cylindric bodies displacably received in a carrier, the inner ends of the bodies contacting a resilient diaphragm closing the pressure chamber towards the bodies. To achieve, in the pressing of the workpiece against the sanding units, also a spring action, and not only a uniform pressure, there is foreseen that the pressurized fluid is air.

BRIEF DESCRIPTION OF THE DRAWINGS

The invention will now be described more in detail, reference being made to the accompanying drawings in which.

DETAILED DESCRIPTION OF THE INVENTION

Figure 1:
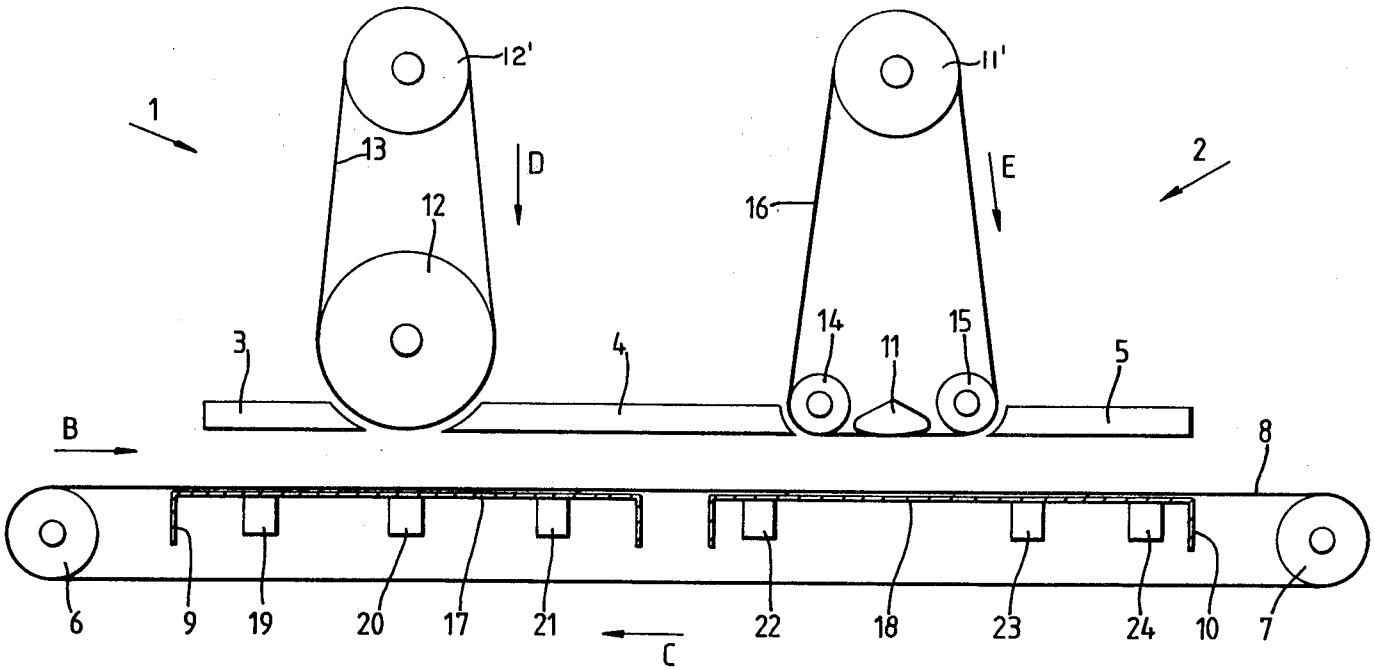
FIG. 1 shows a schematical, longitudinal sectional view of the inventive sanding machine.

In FIG. 1 there is shown the principles of the inventive sanding machine. It is evident that the machine comprises two sanding units provided one after another in the feed direction B of the machine.

In FIG. 1 a first sanding unit 1 comprises a rotating drum for bringing a first sanding belt in contact with the workpiece. A second (in the feed direction) sanding unit 2 comprises a pressure shoe for bringing a second sanding belt in contact with the workpiece. At the feeding side of the first sanding unit there is provided a guide or a so-called pressure beam 3. Between the sanding units there is provided one second guide or pressure beam 4, and finally at the exit side of the second sanding unit there is provided an exit guide or pressure beam 5. Below the sanding units and the pressure beams there is provided a feeding conveyor assembly, usually of belt type and having at least two rollers 6, 7 over which an endless belt 8 passes in the direction of arrow C. Below the upper run of belt 8 there are provided pressure or support tables 9, 10. The under side of the upper run of the belt 8 contacts these tables to press the workpiece carried on belt 8 in the feed direction B against the first and second sanding units 1 and 2 and against the pressure beams or guides 3–5. To allow sanding of workpieces of different thicknesses the feeding conveyor assembly 6–10 is adjustable in the vertical direction relative to sanding units 1,2 and pressure beams 3–5. To adjust the sanding depth of the two sanding units 1,2 their relative vertical settings together with the relative vertical setting of pressure beams 3–5 are adjustable in such a way that the pressure beam is a greater vertical distance from table 9 than is the sanding surface of sanding unit 1. Further, the sanding surface of sanding unit 1 and the intermediate pressure beam 4 are substantially the same vertical distance from tables 9,10, while the pressure shoe 11 and the exit pressure beam 5 are at a slightly lower level than the intermediate pressure beam 4. Just as pressure beam 4 and the sanding surface of sanding unit 1 are at substantially the same level, so too exit pressure beam 5 and the sanding surface of sanding unit 2 are at substantially the same level. Finally, pressure beam 3 is usually resilient in an upward direction to allow feeding of a workpiece having portions protruding upwardly.

According to the invention sanding units 1 and 2 are of conventional type. Thus sanding unit 1 compares a lower drum or roller 12 and an upper roller 12' imparting a suitable tension to sanding belt 13 which moves at a high speed in the direction of arrow D. Like the first sanding unit 1, the second sanding unit 2 comprises a sanding belt 16 which runs in the direction of arrow E, about a front lower roller 14 and a rear lower roller 15. Sanding belt 16 is kept in tension by a further roller 11. At least the front roller 14 is adjustable in the vertical direction and should be set at such a level that its lowermost portion is located one or two millimeters above the lower surface of pressure shoe 11 which is provided between the front and rear rollers 14 and 15. Pressure shoe 11 could, according to the invention, be designed in any way well known in the art compatible with the sanding operations to be achieved.

According to the invention the two tables 9,10 are rigidly mounted in a frame which supports conveyor assembly 6–10. Tables 9,10 are designed as substantially U-shaped beams having planar upper surfaces 17 and 18, respectively, supporting feeding belt 8. At numerals 19–24 in FIG. 1 there are indicated carriers of pressure means for pressing feeding belt 8 towards sanding units 1,2 and pressure beams 3–5. Carriers 19–24 are elongated and extend transversely of the feed direction B across the whole working width of the machine.

Figure 2:
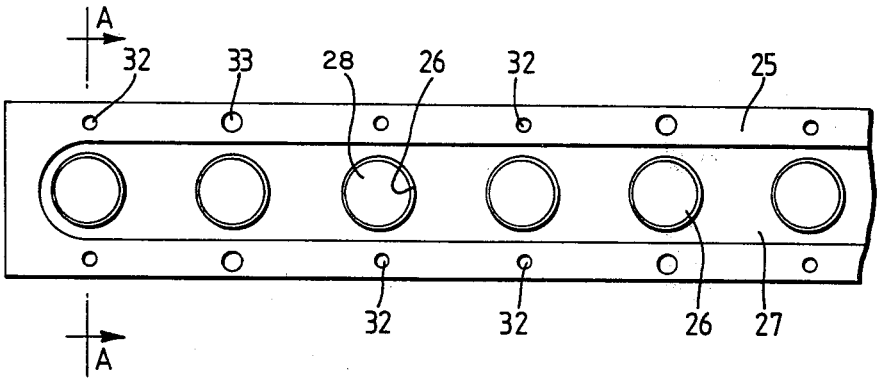
FIG. 2 shows from below substantially on line B—B in FIG. 3, a carrier for the pressure bodies, the lower lid of the carrier being omitted for the sake of clarity.

In FIG. 2 there is shown, as seen from below, the upper part of one of the carriers 19–24 which are fastened to the lower side of the upper portions 17,18 of tables 9 and 10 resp. The portions of carriers 19–24 fastened to tables constitute main portions 25 of the carriers which have a number of parallel bores 26 therethrough perpendicular to the upper sides 17 and 18 of the tables. In practice the diameter of the bores could be approximately 30 millimeters, and their centre to centre distance is preferably approximately 60 millimeters. About the lower ends of bores 26 there is a recessed, continuous area 27 the depth of which is approximately 3–5 millimeters.

Figure 3:
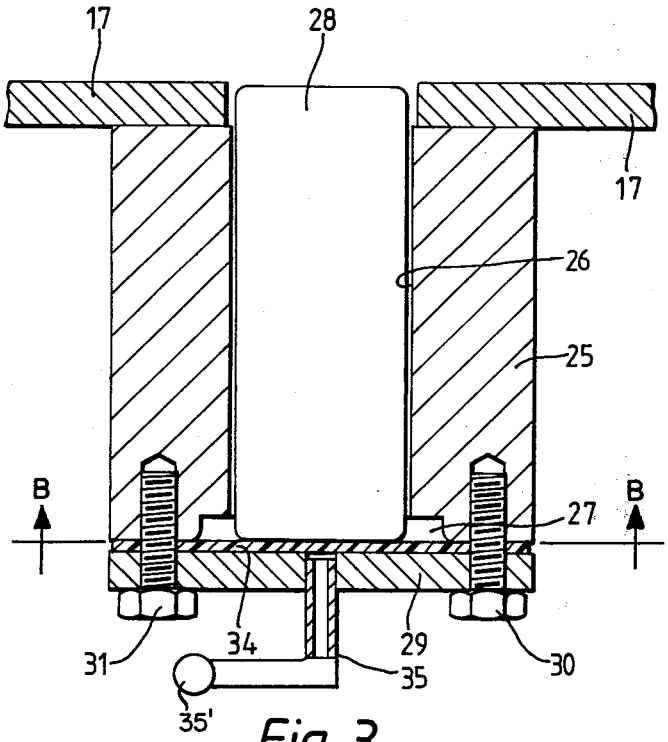
FIG. 3 shows a cross sectional view of the carrier, substantially on line A—A in FIG. 2.

In FIG. 3 there is shown a cross sectional view, substantially on line A—A in FIG. 2. From this fig. there is clearly seen that the main portions 25 of the carriers are fastened (by means of screws not shown) in abutting positions to the lower surfaces of upper portions 17 and 18 of tables 9 and 10 resp. Further, it is evident that bores 26 are perpendicular to the upper portions 17 and 18 of the tables.

As aparent from FIG. 3 there is provided pressure means or studs 28 in the bores 26. Studs 28 are of cylindrical shape and have substantially plane end surfaces, the edges of which are somewhat rounded. Studs 28 have a loose fit in the bores 26 and are displacable in vertical direction (in their longitudinal direction) from the positions of FIG. 3 to elevated positions projecting above the upper surfaces of tables 17,18. The extent of this displacement above the upper surfaces of the tables corresponds to the depth of recesses 27 at the lower side of the main portions 25 of carriers 19–24. From FIG. 3 it is also evident that the carrier includes a lid 29 fastened to the main portion by means of screws 30 and 31. The threaded holes 32 provided for these screws in the main portion 25 are shown in FIG. 2. Through holes 33 are provided in lid 29 and main portion 25 for passage of long bolts which extend from the lower side of lid 29, through the main portion 25 to clamp the whole carrier to the lower side of tables 9,10. Between lid 29 and main portion 25 each carrier is provided with resilient or elastic diaphragm 34 abutting with its upper surface the lower end surfaces of studs 28. Lid 29 is provided with at least one inlet 35 for a pressurized fluid, such as pressurized air, from a source 35'. When letting pressurized air into the space between diaphragm 34 and lid 29 there is created a pressure chamber corresponding to recess 27 at the lower ends of bores 26. Thus, when air is injected via inlet 35 diaphragm 34 flexes upwardly and, at full pressure, abuts the recessed surface 27 and the lower end surfaces of studs 28 so that the studs are lifted a distance corresponding to the depth of recesses 27. At lower pressure in the pressure chamber between diaphragm 34 and lid 29, the diaphragm and the studs take intermediate positions between the above upper end position and the pressure free position of FIG. 3.

Though not shown in FIG. 3 there is preferably provided, at the upper ends of studs 28, one more diaphragm possibly recessed below the upper surfaces of tables 9,10 so that said surfaces are completely flat. Also these diaphragms must be resilient so as not to prevent the vertical movements of studs 28, and then constitute a dust seal at the upper ends of bores 26. As an alternative, the whole upper surfaces of tables 9,10 could be covered by a resilient sheeting fastened and sealed at the edge portions of the tables. Such a sheeting has the same purpose as the above upper diaphragms, i.e. to constitute a dust seal. Furthermore, such a sheeting and also the upper diaphragms could be made from a resilient material also having a low coefficient of friction with the lower surface of feeding belt 8.

As mentioned above the inventive sanding machine can perform two different operations. Firstly, the machine is designed to perform dimendioning or adjusting the workpiece to an almost exact plane-parallel shape.

In this mode of operation the pressure chambers between lids 29 and diaphragms 34 are relieved of pressure, and studs 28 are located at the positions of FIG. 3, thus not engaging feeding belt 8. Tables 9,10 are completely rigid, and furthermore, held stationary in the framework of conveyor assembly 6–10 whereby workpieces having a varying thickness are bought into contact the sanding units 1,2 at only those portions having the greatest thickness. As indicated above, the first pressure beam 3 is spring loaded in this mode of operation to allow feeding of workpieces of the type mentioned.

Figure 4:
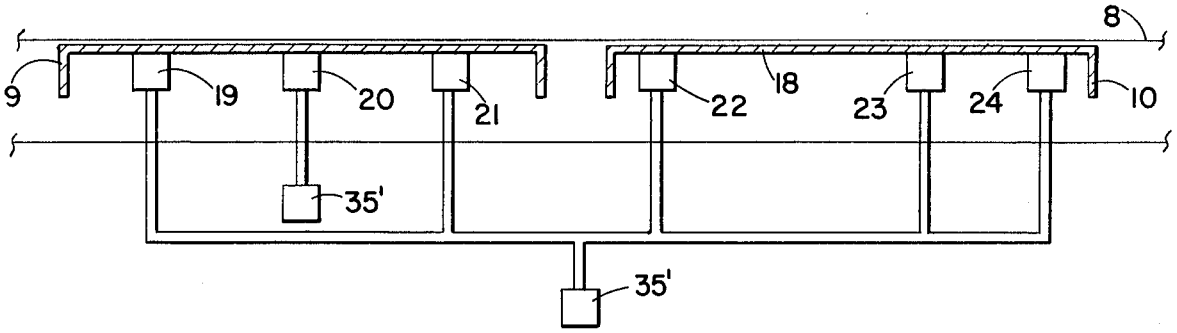
FIG. 4 depicts a modified embodiment of the invention.

Secondly, the inventive sanding mchine also can operate with the tables floating, making possible plane sanding or finish sanding of a workpiece having a thickness varying rather much. In this mode of operation the predetermined sanding depth is not influenced by irregularities in the thickness of the workpiece. Thus, it is possible to perform finish sanding of thin layers of varnish without any risk of sanding through said layers. When performing this operation the pressure chambers in carriers 19–24 between lids 29 and diaphragms 34 are under pressure, flexing the diaphragms upwardly and lifting studs 28 to a level above the upper surface of tables 9 and 10. Preferably, as depicted in FIG. 4, the pressure chambers of carriers 19 and 21–24 are connected to each other to achieve exactly the same pressure in all the pressure chambers 19 and 21–24, while carrier 20 has a separete pressure fluid supply making it possible to have a different pressure in this pressure chamber. By providing a great number of vertically movable studs 28 in tables 9,10 all of which (except possibly those in carrier 20) pressing with exactly the same force against the lower surface of the workpiece, there is achieved a completely uniform pressing of the upper surface of the workpiece against pressure beams 3–5 and sanding units 1,2. This means that the intended sanding depth set by relative vertical adjustment of sanding units 1,2 and pressure beams 3–5 is not influenced by irregularities of the thickness of the workpiece. Thus, it is possible to sand with an accurately predetermined sanding depth one side of a workpiece which is wedge-shaped in a direction transverse to the feeding direction and without altering the wedge-shape. This is achieved by having the different studs 28 of tables 9,10 exposed to upward forces completely independent of the different positions of the studs, the forces being influenced only by the common pressure in the pressure chambers. Locally depressing one or a few studs does not result in a corresponding local increase of the contact pressure against the sanding units but only results in a very small increase of the common pressure in the pressure chambers connected to each other. This pressure could also be kept substantially constant and independent of such depressions of certain studs if the pressure in said chambers is controlled by a suitable pressure regulator.

The invention could be modified within the scope of the following claims. Thus, it is possible to provide studs 28 in a pattern different from that mentioned above where the studs are arranged in rows transversely of feeding direction and in lines one after another in the feeding direction. Such alternative patterns could include arranging the studs in rows transversely of the feeding direction but placing the studs of different rows in a staggered relationship. Further, it is also possible to use a more random arrangement of the studs, although, in all alternatives, the pressure chambers for the different studs or groups of studs should be connected to each other as mentioned above. Finally, the sanding machine could also, contrary to that stated above, be equipped with two sanding units having sanding drums only and one sanding unit having a pressure shoe, or vice versa. In such a case the number of studs is preferably increased correspondingly.

I claim:

1. A belt sanding machine comprising:

a sanding unit having a feed direction with a feed end and an exit end with respect to said feed direction;

guide means at said feed and exit ends for setting the sanding depth of said sanding unit;

a flexible feed conveyor for feeding workpieces to be sanded in the feed direction past said sanding unit; and a pressure table on the side of said feed conveyor opposite said sanding unit for pressing a workpiece positioned on said feed conveyor against said sanding unit and said guide means as the workpiece is fed past said sanding unit by said feed conveyor, said pressure table including a rigid planar support member rigidly set a preselected distance from said guide means, said support member having a plurality of openings therethrough; a plurality of pressure members, each pressure member movable through an associated support member opening between a retracted position in which said pressure member is retracted within said planar support member, allowing said feed conveyor to contact said planar support member to constitute a rigid support surface for pressing a workpiece against said sanding unit, and an extended position in which said pressure member extends through the associated support member opening to move said feed conveyor a distance from said planar support member; and means for resiliently urging each of said pressure members in their extended positions against said feed conveyor with substantially the same force so that said feed conveyor constitutes a resilient and flexible support surface for pressing a workpiece positioned thereon with a substantially constant pressure at any location thereof against said sanding unit and said guide means.

2. A belt sanding machine as claimed in claim 1 in which the openings through said planar support member are arranged in a plurality of rows, each row extending transversely of the feed direction and in whih said resiliently urging means includes means for resiliently urging each of the pressure members associated with any row of planar support member openings from the retracted position to the extended position.

3. A belt sanding machine as claimed in claim 1 or 2 in which each of said pressure members comprises a cylindrical body member having its longitudinal axis passing through the associated support member opening and in which said resiliently urging means comprises resilient diaphragm means and a source of pressurized fluid for resiliently urging said diaphragm means against an end of each of said cylindrical body members.

4. A belt sanding machine as claimed in claim 3 in which:

said sanding unit comprises a first sanding belt, a roller, and first drive means driving said first sanding belt about said roller;

in said feed direction said guide means comprises a first component in front of said first sanding belt and a second component behind said first sanding belt; and the openings through said planar support member are arranged with at least one row thereof adjacent each of said guide means components and with one row adjacent said first sanding belt; and said resiliently urging means comprises first urging means for urging the pressure members associated with said last named row of openings through said planar support member from the retracted position to the extended position and second urging means for urging the remaining pressure members from the retracted position to the extended position.

5. A belt sanding machine as claimed in claim 4 in which:

said sanding unit further comprises a second sanding belt, a pressure shoe, and second drive means driving said second sanding belt about said pressure shoe; and said guide means second component is between said first and second sanding belts and said guide means further comprises a third component behind said second sanding belt in said feed direction.

6. A belt sanding machine as claimed in claim 1 or 2 in which:

said sanding unit comprises a first sanding belt, a roller, and first drive means driving said first sanding belt about said roller;

in said feed direction said guide means comprises a first component in front of said first sanding belt and a second component behind said first sanding belt; and the openings through said planar support member are arranged with at least two row thereof adjacent each of said guide means components and with one row adjacent said first sanding belt; and said resiliently urging means comprises first urging means for urging the pressure members associated with said last named row of openings through said planar support member from the retracted position to the extended position and second urging means for urging the remaining pressure members from the retracted position to the extended position.

7. A belt sanding machine as claimed in claim 6 in which:

said sanding unit further comprises a second sanding belt, a pressure shoe, and second drive means driving said second sanding belt about said pressure shoe; and said guide means second component is between said first and second sanding belts and said guide means further comprises a third component behind said second sanding belt in said feed direction.

8. A belt sanding machine comprising:

a sanding unit having a feed direction with a feed end and an exit end with respect to said feed direction;

guide means at said feed and exit ends for setting the sanding depth of said sanding unit;

a flexible feed conveyor for feeding workpieces to be sanded in the feed direction past said sanding unit;

a table on the side of said feed conveyor opposite said sanding unit, said table having a plurality of openings therethrough;

a plurality of pressure members, each pressure member movable through an associated opening in said table to movably support said feed conveyor at a distance from said table;

resilient diaphragm means on the side of said table opposite said feed conveyor and contacting said pressure members; and a source of pressurized fluid for extending said diaphragm means to urge each of said pressure members against said feed conveyor with equal force regardless of the relative amount by which each of said pressure members extends through the associated opening.

9. A belt sanding machine as claimed in claim 8 in which the openings through said table are arranged in a plurality of rows, each row extending transversely of the feed direction, with at least one row thereof adjacent said guide means and one row adjacent said sanding unit.

* * * * *